US009274493B2

(12) United States Patent
Mori

(10) Patent No.: US 9,274,493 B2
(45) Date of Patent: Mar. 1, 2016

(54) IMAGE FORMING APPARATUS INTERNALLY PROVIDED WITH SHIELD FOR PREVENTING FOREIGN LIGHT FROM REACHING LIGHT SENSITIVE AREA

(71) Applicant: Brother Kogyo Kabushiki Kaisha, Nagoya (JP)

(72) Inventor: Shogo Mori, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/478,041

(22) Filed: Sep. 5, 2014

(65) Prior Publication Data

US 2015/0093148 A1 Apr. 2, 2015

(30) Foreign Application Priority Data

Sep. 30, 2013 (JP) ..... 2013-205191

(51) Int. Cl.
*G03G 21/16* (2006.01)

(52) U.S. Cl.
CPC ..... *G03G 21/1676* (2013.01); *G03G 21/1619* (2013.01); *G03G 21/1666* (2013.01)

(58) Field of Classification Search
CPC ..... G03G 21/1633; G03G 21/1676; G03G 21/1623; G03G 21/1619; G03G 2221/1684; G03G 2221/163; G03G 15/0896
USPC ..... 399/107, 110, 119, 120
See application file for complete search history.

(56) References Cited

U.S. PATENT DOCUMENTS 7,650,087 B2 * 1/2010 Nagata et al. ..... 399/27
2008/0212989 A1 * 9/2008 Nagata ..... G03G 15/0886 399/61
2010/0080615 A1 * 4/2010 Kikuchi ..... 399/111

FOREIGN PATENT DOCUMENTS

JP 2012-168570 A 9/2012

* cited by examiner

*Primary Examiner* — Walter L Lindsay, Jr.
*Assistant Examiner* — Jessica L Eley
(74) *Attorney, Agent, or Firm* — Burr & Brown, PLLC

(57) ABSTRACT

An image forming apparatus includes a casing, a photosensitive drum, an exposure head, a developing cartridge, and a light shielding member. The photosensitive drum is rotatably disposed inside the casing. The exposure head is configured to expose the peripheral surface of the photosensitive drum to light. The developing cartridge includes a developing roller configured to supply the developer onto the peripheral surface of the photosensitive drum. The developing cartridge is mountable in and dismountable from the casing. The developing cartridge has an uppermost point and is disposed beneath the exposure head when mounted in the casing. The light shielding member has a first portion disposed between the exposure head and the developing roller and intersecting with an imaginary plane defined by inclusion of the axial line of the photosensitive drum and the uppermost point of the developing cartridge.

8 Claims, 8 Drawing Sheets

IMAGE FORMING APPARATUS INTERNALLY PROVIDED WITH SHIELD FOR PREVENTING FOREIGN LIGHT FROM REACHING LIGHT SENSITIVE AREA

CROSS REFERENCE TO RELATED APPLICATION

This application claims priority from Japanese Patent Application No. 2013-205191 filed Sep. 30, 2013. The entire content of the priority application is incorporated herein by reference.

TECHNICAL FIELD

The present invention relates to an electrophotographic image forming apparatus including a photosensitive drum.

BACKGROUND

Conventional electrophotographic image forming apparatuses generally include a photosensitive drum, an exposure head and a developing cartridge. The exposure head is provided for exposing the peripheral surface of the photosensitive drum to imaging light. The developing cartridge stores developer to be supplied to the photosensitive drum. Japanese Patent Application Publication No. 2012-168570 discloses an image forming apparatus of the type described above, and shows an arrangement in which the developing cartridge is spaced apart from and disposed below the exposure head.

SUMMARY

With such an arrangement, there is likelihood of accidental exposure of the photosensitive drum with foreign light entering into the apparatus. The foreign light may enter thereinto when strong intensity light, e.g., sunlight, falls on the sidewall of the apparatus. To prevent deterioration of the photosensitive drum, such an accidental exposure of the photosensitive drum needs to be avoided.

In view of the foregoing, it is an object of the invention to provide an image forming apparatus capable of shielding foreign light so as not reach the photosensitive drum.

To achieve the above and other objects, an image forming apparatus is proposed which may include a casing, a photosensitive drum, an exposure head, a developing cartridge, and a light shielding member. The photosensitive drum may be rotatably disposed inside the casing and have a peripheral surface and an axial line. The exposure head may be disposed to face the peripheral surface of the photosensitive drum. The exposure head may be configured to expose the peripheral surface of the photosensitive drum to light. The developing cartridge may include a developing roller. The developing roller may have a peripheral surface on which developer is born and be configured to supply the developer onto the peripheral surface of the photosensitive drum. The developing cartridge may be mountable in and dismountable from the casing. The developing cartridge may have an uppermost point and be disposed beneath the exposure head when mounted in the casing. The light shielding member may have a first portion that is disposed between the exposure head and the developing roller and intersects with an imaginary plane defined by inclusion of the axial line of the photosensitive drum and the uppermost point of the developing cartridge.

BRIEF DESCRIPTION OF THE DRAWINGS

The particular features and advantages of the invention as well as other objects will become apparent from the following description taken in connection with the accompanying drawings, in which.

DETAILED DESCRIPTION

One embodiment of the present invention will be described with reference to the accompanying drawings. The embodiment pertains to a laser printer as example of image forming apparatuses. In the following description, the terms "upward", "downward", "upper", "lower", "above", "below", "beneath" and the like will be used throughout the description assuming that the laser printer is disposed in an orientation in which it is intended to be used as shown in FIG. 1.

Figure 1:
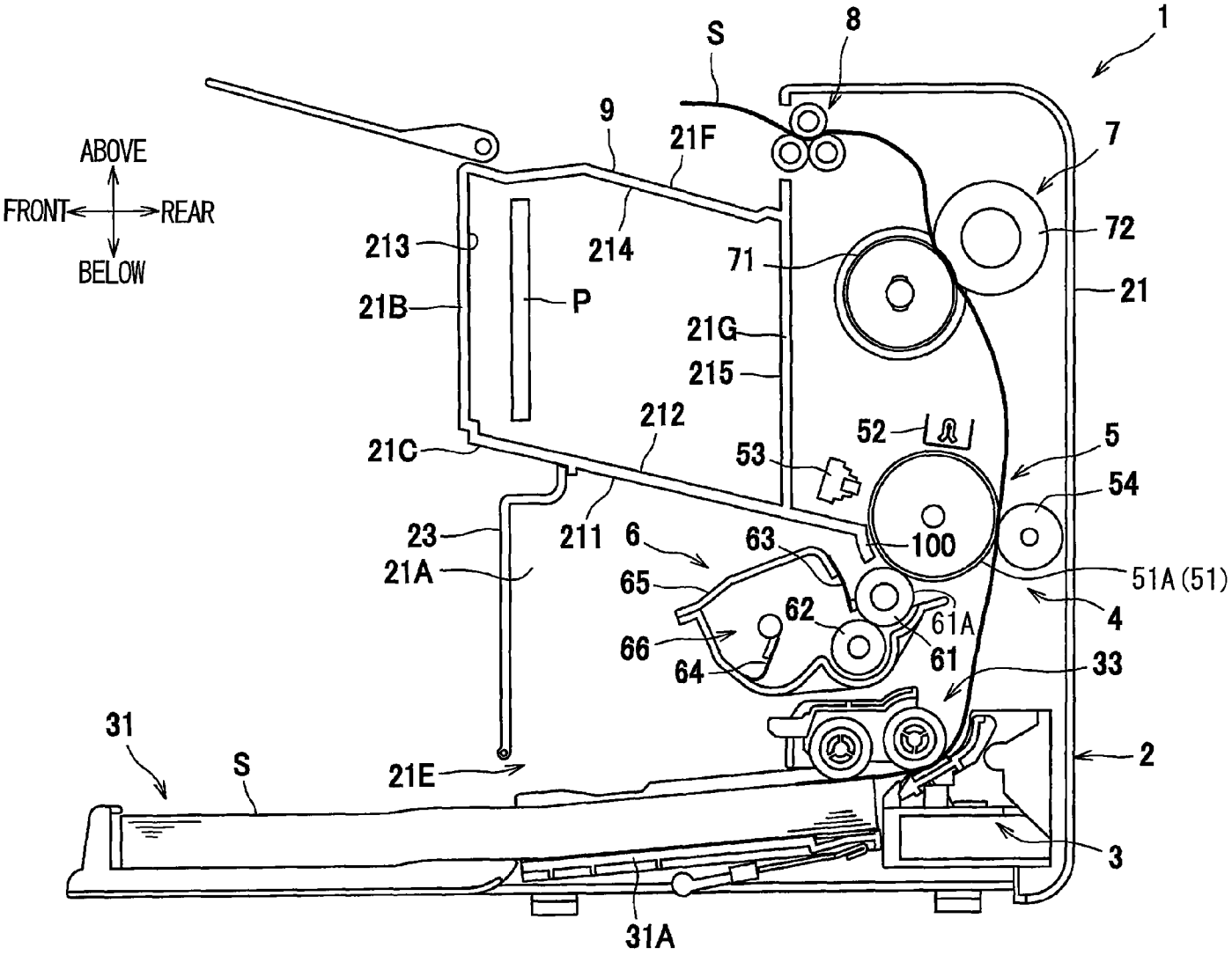
FIG. 1 is a schematic cross-sectional view showing a laser printer according to one embodiment of the present invention.

As shown in FIG. 1, the laser printer 1 includes a main unit 2; a sheet feed section 3 for supplying a sheet of paper S; an image forming section 4 for forming images on the sheet of paper S; and a circuit board P. The main unit 2 includes a housing 21 serving as an example of a casing, and a front cover 23 serving as an example of a cover. The housing 21 includes left and right side frames 21A and a front wall 21B. The side frames 21A are disposed-in spaced apart in the right and left direction and in confronting relation with each other.

The image forming section 4 is interposed between the side frames 21A. The front wall 21B is coupled to the front end portions of the left and right side frames 21A. In the coupled state, the lower end of the front wall 21B is positioned above the lower end of each of the pair of side frames 21A. Specifically, the lower end of the front wall 21B is nearly the same in a vertical level as an axial line of a photosensitive drum 51 described later. The front side of the housing 21 is formed with an opening 21C at the lower portion thereof. Specifically, the opening 21C is defined by the pair of side frames 21A and the front wall 21B and defined below the front wall 21B.

The front cover 23 is provided for covering an upper part of the opening 21C. The front cover 23 is hinged to the housing 21 to be pivotally movable between an upstanding posture and a horizontally laid posture. When the front cover 23 is in the upstanding posture, the upper part of the opening 21C is covered whereas when the front cover 23 is in the horizontally laid posture, the upper part of the opening 21C is exposed.

Figure 2:
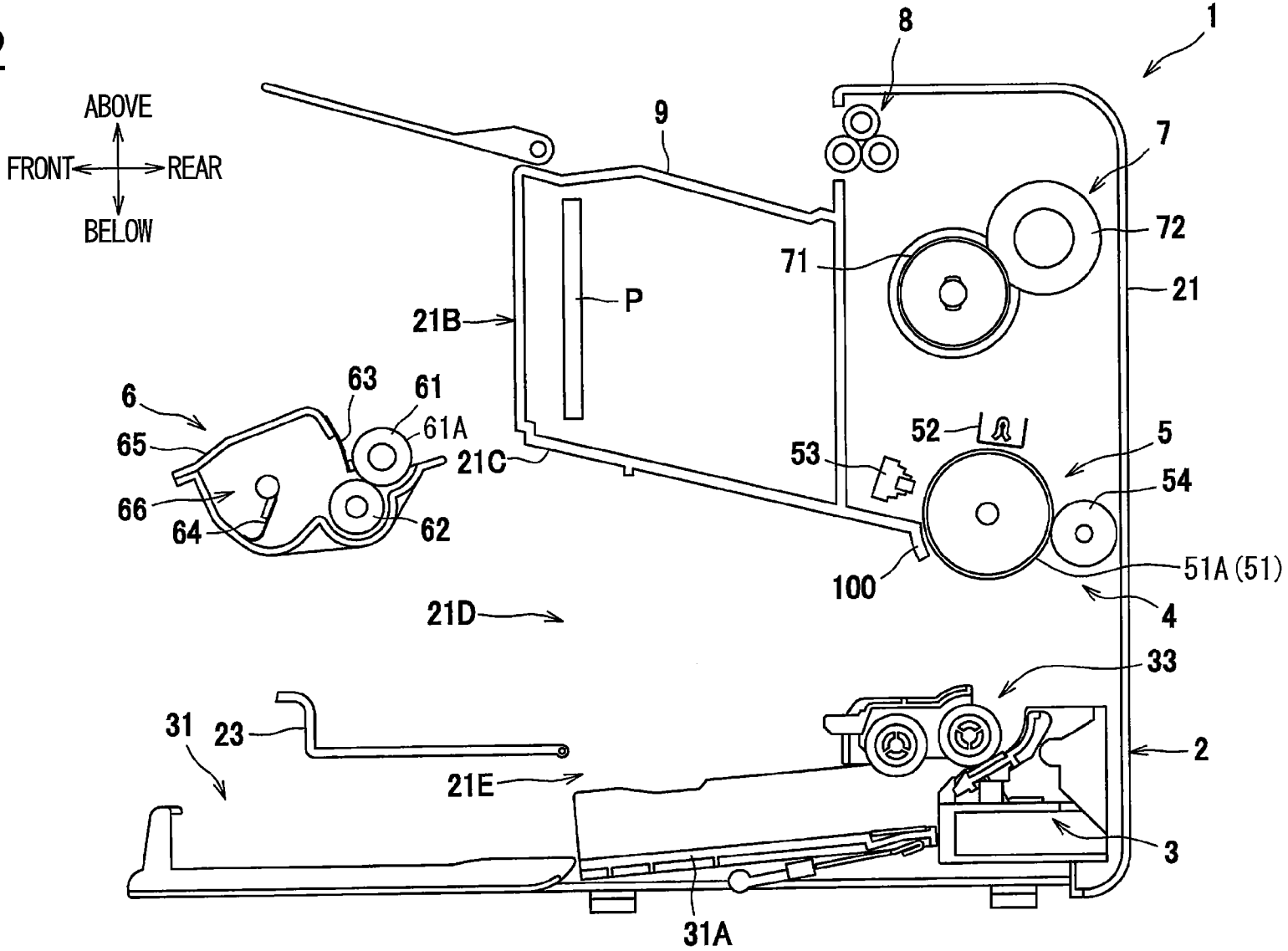
FIG. 2 is a schematic cross-sectional view showing the laser printer from which a developing cartridge is removed.

The front cover 23 partitions the opening 21C into a developing cartridge mounting/dismounting port 21D and a sheet insertion port 21E (see FIG. 2). The former port 21D is positioned above the lower end of the front cover 23, and the latter port 21E below the lower end of the front cover 23.

The sheet feed section 3 is disposed in the bottom portion of the main unit 2, and includes a sheet feed tray 31 and a sheet feed mechanism 33. The sheet feed tray 31 receives a sheet of paper S inserted through the sheet insertion port 21E. The sheet feed mechanism 33 is configured to feed the uppermost sheet of paper S stacked on the sheet feed tray 31 toward the image forming section 4. The sheet feed tray 31 is horizontally elongated to protrude out of the housing 21 through the sheet insertion port 21E. The sheet feed tray 31 is provided with a sheet pressing plate 31A disposed in the bottom portion of the housing 21.

In the sheet feed section 3, a stack of sheets of paper S on the sheet feed tray 31 is upwardly urged against a roller included in the sheet feed mechanism 33 by the sheet pressing plate 31A. The uppermost sheet of paper S is fed toward the image forming section 4 by virtue of the sheet feed mechanism 33.

The image forming section 4 includes a process unit 5 and a thermal fixing unit 7. The process unit 5 includes the photosensitive drum 51, a charger 52, an exposure head 53, a transfer roller 54, and a developing cartridge 6. The photosensitive drum 51 is disposed within the main unit 2 and above the sheet feed mechanism 33. The photosensitive drum 51 is cylindrically elongated and rotatable about the axial line X. The charger 52 is disposed above the photosensitive drum 51. The charger 52 extends in an axial direction (or widthwise direction) of the photosensitive drum 51 and faces the latter to uniformly charge the peripheral surface of the photosensitive drum 51.

The exposure head 53 is disposed at the front side of the photosensitive drum 51. That is, the exposure head 53 is interposed between the front cover 23 and the photosensitive drum 51. The exposure head 53 is also elongated to extend in the axial direction of the photosensitive drum 51 and has a tip end portion facing the peripheral surface of the photosensitive drum 51. Light is emitted from the tip end portion of the exposure head 53. Specifically, a plurality of light emitting diodes (LEDs) is arrayed in the widthwise direction on the tip end portion of the exposure head 53. The plurality of LEDs selectively emits light in response to image data, thereby exposing the precharged surface of the photosensitive drum 51 to light and forming an electrostatic latent image thereon. The transfer roller 54 is disposed at the rear side of the photosensitive drum 51 and is closely positioned with respect to the photosensitive drum 51.

As can be understood from FIG. 2, the main unit 2 is configured so that the developing cartridge 6 can be mounted therein or dismounted therefrom through the developing cartridge mounting/dismounting port 21D exposed when the front cover 23 is brought to the horizontally laid posture.

Referring back to FIG. 1, the developing cartridge 6 mounted in the main unit 2 is disposed below the exposure head 53. The developing cartridge 6 includes a developing roller 61, a developer supplying roller 62, a developer thickness regulating blade 63, an agitator 64, and a cartridge frame 65 for supporting those components of the developing cartridge 6. The cartridge frame 65 is a cylindrical-shape container extending in the widthwise direction and has a toner container 66 in which toner, one example of developer, is stored. The cartridge frame 65 supports the developing roller 61, toner supplying roller 62 and developer thickness regulating blade 63 at the rear side of the toner container 65.

In operation, the peripheral surface of the photosensitive drum 51 is uniformly charged by the charger 52 while the drum 51 is rotating. Then, the precharged surface of the photosensitive drum 51 is exposed to imaging light by the exposure head 53. Electrical potential at the exposed portions is lowered, resulting in formation of an electrostatic latent image on the photosensitive drum 51.

Toner stored in the toner container 66 is agitated by the agitator 64. While agitating the toner with the agitator 64, toner is carried onto the developer supplying roller 62, and then relayed to the developing roller 61. In accordance with rotations of the developing roller 61, toner on the developing roller 61 is subjected to thickness regulation by the developer thickness regulation blade 63, so that the developing roller 61 bears a toner layer with a uniform thickness on its peripheral surface. That is, the toner thickness regulating blade 63 regulates the thickness of the toner layer born on the peripheral surface of the developing roller 61.

Toner born on the developing roller 61 is supplied onto the peripheral surface of the photosensitive drum 51, thereby developing the electrostatic latent image. Through such a developing process, a visible toner image is formed on the photosensitive drum 51. The toner image on the photosensitive drum 51 is then transferred onto the sheet of paper S passing through a nip between the photosensitive drum 51 and the transfer roller 54.

The thermal fixing unit 7 is disposed above the process unit 5 and includes a heat roller 71 and a backup roller 72. The heat roller 71 has a heat source, such as halogen lamp, in its interior. The heat roller 71 and the backup roller 72 nip and convey the sheet of paper S. The backup roller 71 is disposed at a position diagonally upside with respect to the heat roller 71. The thermal fixing unit 7 thermally fixes the toner image deposited on the sheet of paper S when the latter passes through the nip between the heat roller 71 and the backup roller 72. The sheet of paper S with the toner image thermally fixed is then conveyed toward a set of discharge rollers 8 disposed in a downstream side of the thermal fixing unit 7 with respect to a sheet conveying direction. The set of discharge rollers 8 then conveys the sheet of paper S onto a discharge tray 9 disposed above the main unit 2.

The circuit board P is configured to electrically power the image forming section 4 and any other electrical sections and disposed at a rear side position of the front wall 21B.

A light shielding wall 100 serving as an example of a light shielding member is provided between the opening 21C and the photosensitive drum 51. In other words, the opening 21C is positioned at the front side of the light shielding wall 100, and the photosensitive drum 51 at the rear side of the light shielding wall 100. The laser printer 1 or the housing 21 has an upper wall 21F and a partitioning wall 21G that is provided between the circuit board P and the exposure head 53.

Figure 4:
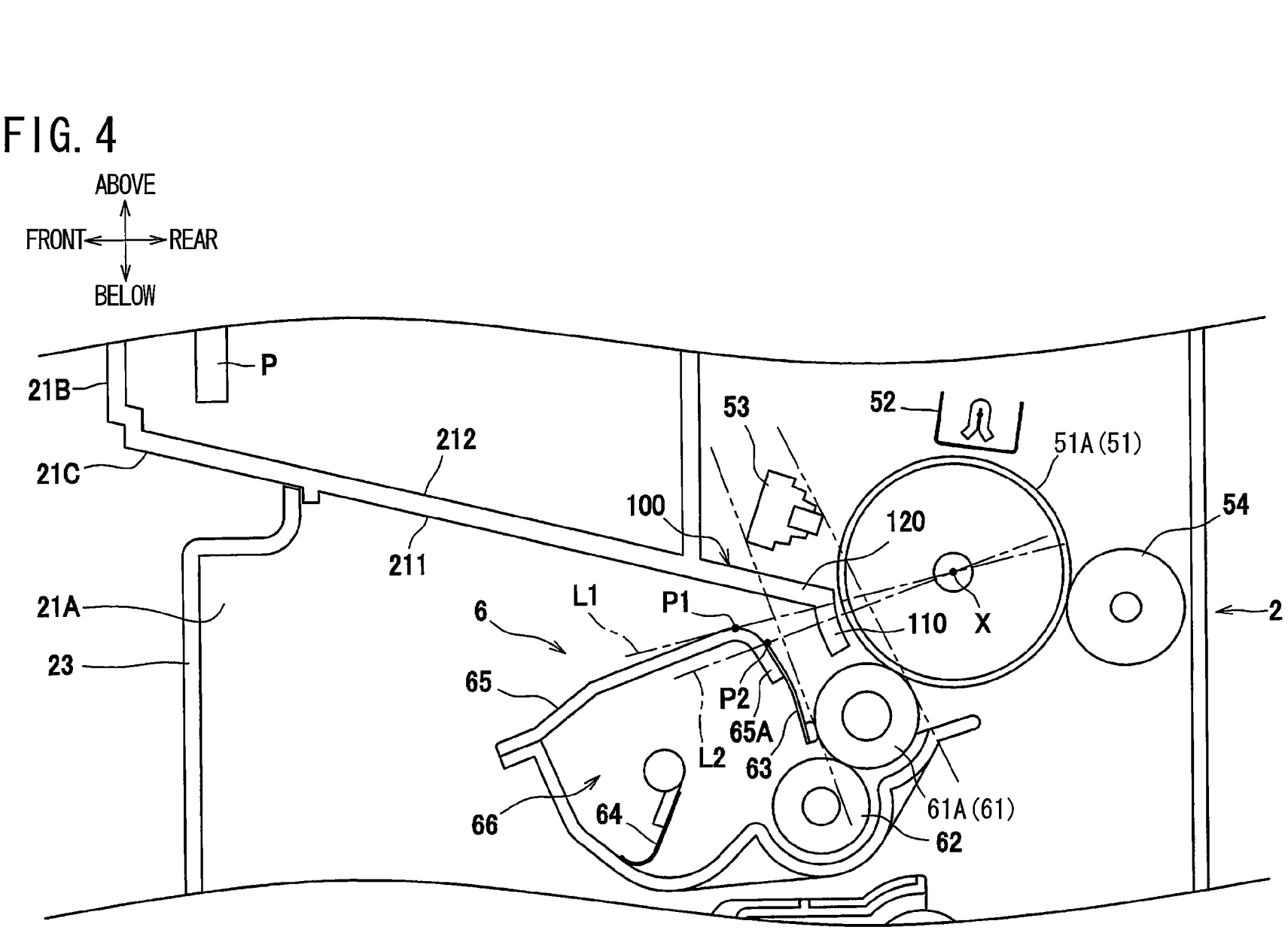
FIG. 4 is an enlarged diagram showing a light shielding wall and components disposed therearound.

As shown in FIG. 4, the light shielding wall 100 has a generally L-shaped cross-section and includes a first segmental wall 110 and a second segmental wall 120. The first segmental wall 110 is provided to cover a part of the photosensitive drum 51 where foreign light which may enter from the opening 21C and reach the photosensitive drum 51. The first segmental wall 110 extends along the periphery of the photosensitive drum 51 as viewed in cross-section. The second segmental wall 120 extends frontward from one end of the first segmental wall 110 and is positioned below the exposure head 53 and above the developing roller 61. The second segmental wall 120 is provided for covering the exposure head 53 or partitioning between the exposure head 53 and the developing roller 61.

The vertical position of the second segmental wall 120 may be varied, provided that the second segmental wall 120 is in between the exposure head 53 and the developing roller 61, and the free end of the first segmental wall 110 is not brought into contact with the developing roller 61. Possible vertically variable range is limited such that the root portion of the second segmental wall 120 near the first segmental wall 110 falls within a space surrounded by two two-dotted-chain lines shown in FIG. 4.

Figure 3:
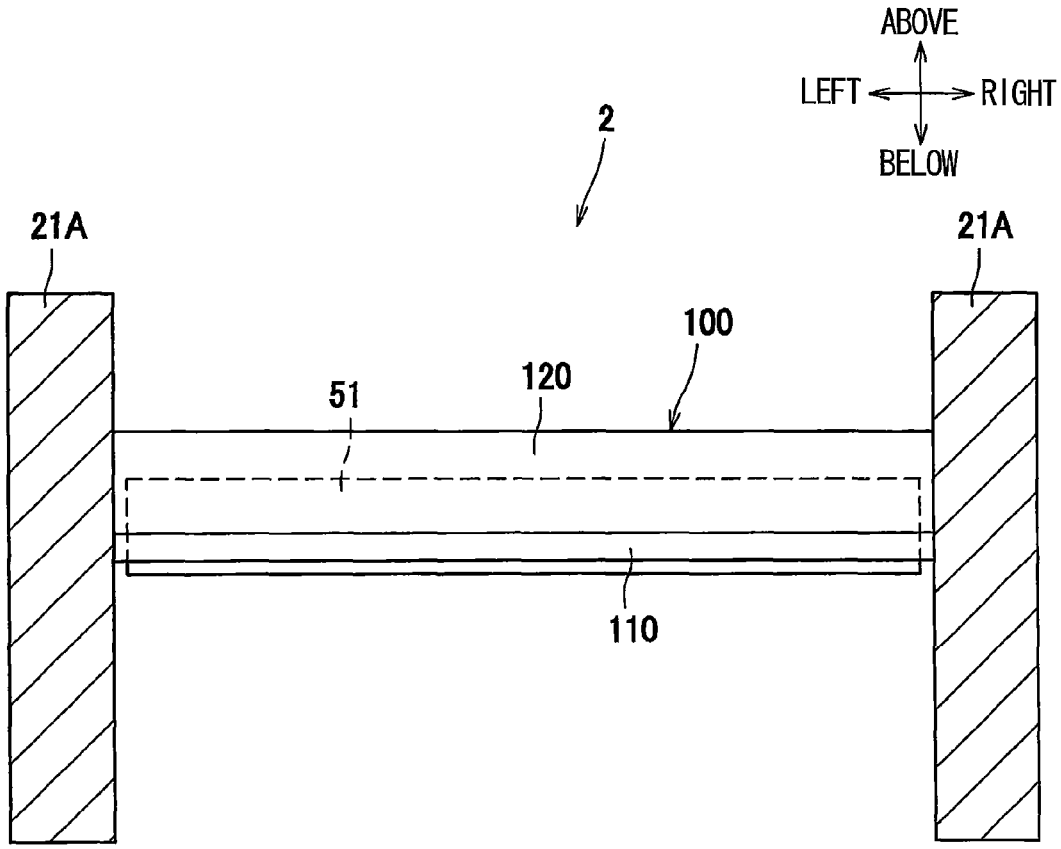
FIG. 3 is a cross-sectional view showing a side frame and a light shielding wall.

As shown in FIG. 3, the light shielding wall 100 is bridged between a pair of side frames 21A. Both end faces of the light shielding wall 100 are secured to the respective side frames 21A. The light shielding wall 100 needs to have a light shielding property. To this effect, it is desirable that the light shielding wall 100 have a thickness enough to prevent light from passing therethrough and also the light shielding wall 100 have a black color surface.

As best shown in FIG. 4, the first segmental wall 110 extends generally vertically and its lower end is positioned in a triangular space surrounded by peripheral surfaces of both the photosensitive drum 51 and the developing roller 61.

Next, an arrangement of the developing cartridge 6 according to the embodiment will be described in detail.

The upper side cartridge frame 65 constitutes an upper wall of the toner container 66. The rear part of the upper side cartridge frame 65 is downwardly bent from the point P1 and used as a fixing wall 65A for fixing the thickness regulating blade 63. The point P1 is the uppermost position of the developing cartridge 6. In a state where the developing cartridge 6 is mounted in the main unit 2, the fixing wall 65A is positioned ahead of the photosensitive drum 51, and the point P1 is higher than the developing roller 61.

The thickness regulating blade 63 has one end fixedly secured to the fixing wall 65A. The blade 63 extends downward to be positioned at the front side of the developing roller 61 so that the other end thereof is in contact with the peripheral surface of the developing roller 61.

Next, a positional relation between the light shielding wall 100 and the components disposed therearound will be described while referring to FIG. 4.

As shown in FIG. 4, the first segmental wall 110 of the light shielding wall 100 intersects with a plane L1 defined by inclusion of the axial line X of the photosensitive drum 51 and the point P1 where is the uppermost position of the developing cartridge 61. Further, the first segmental wall 110 also intersects with a plane L2 defined by inclusion of the axial line X of the photosensitive drum 51 and the upper end P2 of the thickness regulating blade 63.

The second segmental wall 120 of the light shielding wall 100 is continuous from the upper end of the first segmental wall 110 and extends frontward while passing through a space between the exposure head 53 and the developing roller 61. The frontmost end portion of the second segmental wall 120 is positioned below the circuit board P and above the front cover 23. When the front cover 23 is closed, the same is brought into engagement with the second segmental wall 120. The second segmental wall 120 has an inner surface 211 facing downward to confront the developing cartridge 6 and an outer surface 212 facing upward to confront the circuit board P.

Figure 5:
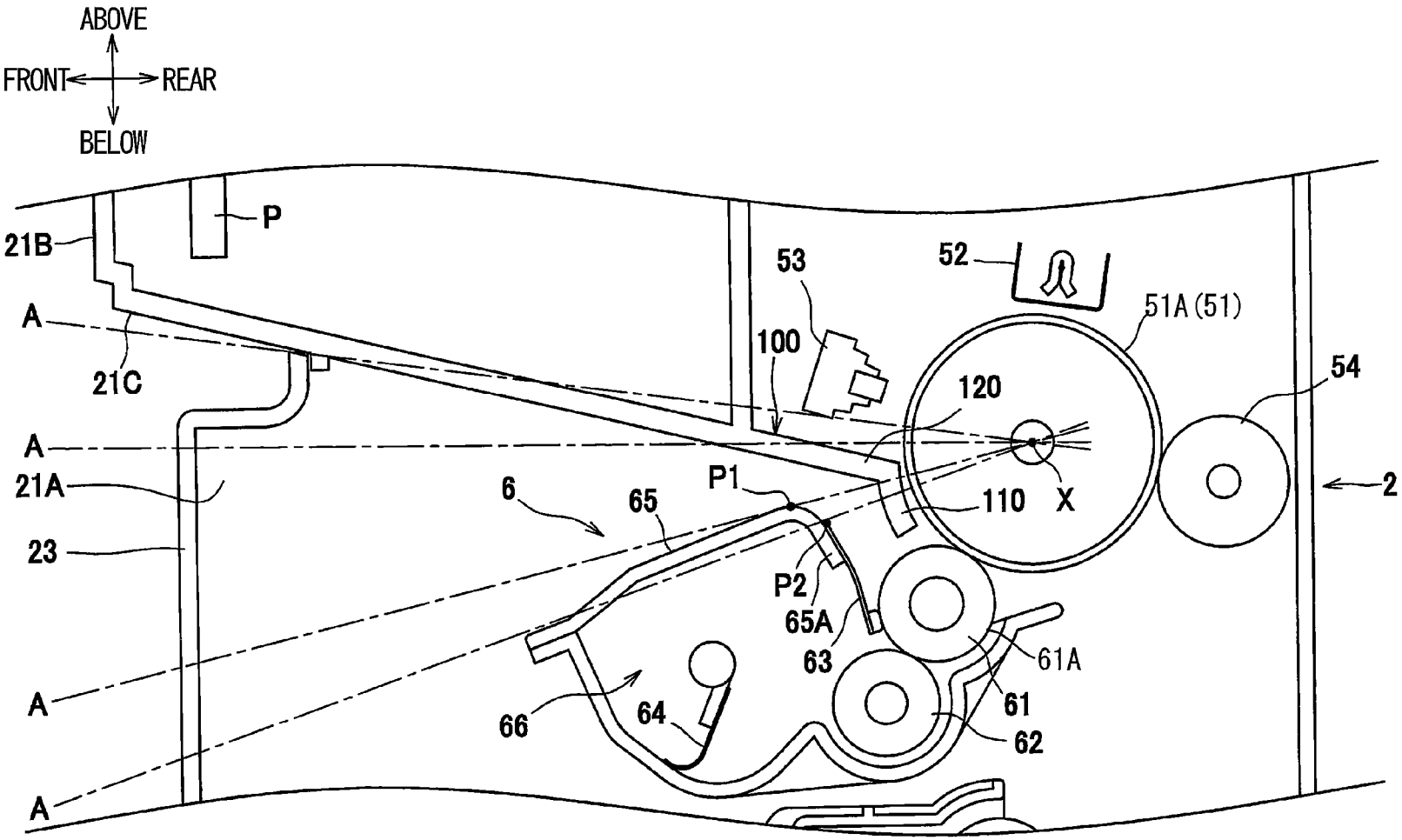
FIG. 5 is an explanatory diagram showing positional relationships among a front cover, the light shielding wall, and the developing cartridge.

As shown in FIG. 5, an imaginary plane A defined by inclusion of the axial line X of the photosensitive drum 51 and an arbitrarily selected point on the front cover 23 intersects with at least one of the first segmental wall 110, the second segmental wall 120, and the developing cartridge 6.

Referring back to FIG. 1, the upper wall 21F extends rearward from the upper end of the front wall 21B to the position beneath the set of discharge rollers 8. The discharge tray 9 is configured in a part of the upper wall 21F. The partitioning wall 21G extends downward from the rear end of the upper wall 21F and coupled to the second segmental wall 120 of the light shielding wall 100. The circuit board P is disposed in a space defined by the front wall 21B, the second segmental wall 120, the upper wall 21F and the partitioning wall 21G. In other words, each of the inner side surface 213 of the front wall 21B, the inner side surface 214 of the upper wall 21F, the front side surface 215 of the partitioning wall 210, and the upper side surface 212 of the second segmental wall 120 is in confronting relation with the circuit board P.

With the laser printer 1 having an arrangement described above, strong intensity light falling on the front face of the main unit 2 may enter into the main unit 2 if the front cover 23 is not so thick as to prevent the light from passing therethrough or if the front cover 23 is so colored as to allow the light to pass therethrough. Nevertheless, the light sensitive area in the laser printer 1 is not adversely affected by the light entered into the main unit 2 because such foreign light is blocked by the light shielding wall 100 formed between the exposure head 53 and he developing roller 61. The light shielding wall 100 prevents the light entering into the main unit 2 from reaching the peripheral surface of the photosensitive drum 51. As such, accidental or unwanted exposure of the photosensitive drum 51 by the foreign light can be effectively prevented.

As shown in FIG. 4, having the first segmental wall 110 disposed in the triangular space formed between the photosensitive drum 51 and the developing cartridge 6, the light shielding wall 100 is capable of shielding the light entering from positions beneath the uppermost point P1 of the developing cartridge 6, preventing the photosensitive drum 51 from being exposed to foreign light.

Further, the second segmental wall 120 of the light shielding wall 100 extends to the upper part of the front cover 23 and engages the front wall 21B, so that light entered into the main unit 2 from the upper side thereof can also be blocked.

As shown in FIG. 5, the imaginary plane A defined by inclusion of the axial line X of the photosensitive drum 51 and an arbitrarily selected point on the front cover 23 intersects with at least one of the first segmental wall 110, the second segmental wall 120 and the developing cartridge 6. This means that the light passing through the front cover 23 is shielded by any one of the first segmental wall 110, the second segmental wall 120 and the developing cartridge 6. As such, the photosensitive drum 51 is prevented from being exposed to foreign light.

The provision of the light shielding wall 100 is advantageous in that the exposure head 53 is prevented from being polluted with toner scattered when toner is scraped off from the developing roller 61 by the thickness regulating blade 63, because the second segmental wall 120 of the light shielding wall 100 is disposed below the exposure head 53 and above the developing roller 61 and the thickness regulating blade 63.

Furthermore, the provision of the second segmental wall 120 of the light shielding wall 100 serves to protect the exposure head 53 so as not to impinge against the developing frame 65 and/or developing roller 61 when the developing cartridge 6 is mounted in or dismounted from the main unit 2.

Although the present invention has been described with respect to a specific embodiment, it will be appreciated by one skilled in the art that a variety of changes and modifications may be made without departing from the scope of the invention. In the following description regarding various modifications, the same or corresponding components as those of the laser printer 1 according to the above-described embodiment will be denoted by the same reference numerals, and duplicating description thereof will be omitted.

Figure 6:
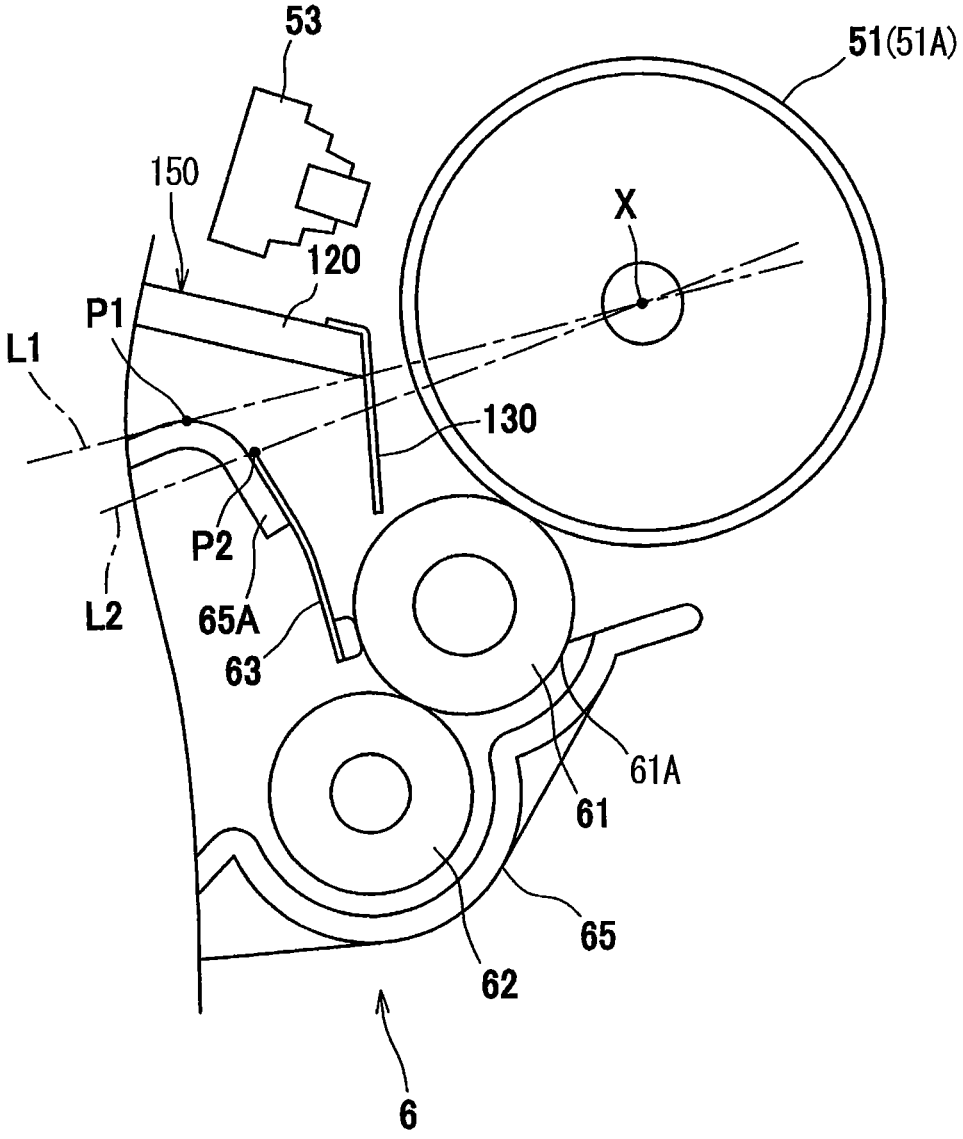
FIG. 6 is a cross-sectional view showing a light shielding wall of a laser printer according to a first modification of the present invention.

While in the above-described embodiment, the light shielding wall 100 is configured of the first and second segmental walls 110, 120 in which the first segmental wall 110 extends to the second segmental wall 120 to be integral with the latter, the structure of the light shielding wall 10 is not limited to such a configuration. For example, as shown in FIG. 6, a light shielding member 150 may be used as the light shielding member instead of the light shielding wall 100. The light shielding member 150 includes the second segmental wall 120 and a light shielding film 130 (first segmental wall) attached to the rear end of the second segmental wall 120. The light shielding film 130 generally extends along the periphery of the photosensitive drum 51 and disposed in a triangular space formed between the photosensitive drum 51 and the developing roller 61. The triangular space referred to herein is defined by the peripheral surfaces of the photosensitive drum 51 and the developing roller 61, and a tangential line connecting the photosensitive drum 51 and the developing roller 61. Of the two triangular spaces as defined above, the one in which the light shielding film 130 is disposed is at the side of the light shielding member 150. The light shielding member 150 as shown in FIG. 6 has a foreign light shielding capability as in the above-described embodiment and is effective in blocking the foreign light from reaching the photosensitive drum 51 and hence preventing the photosensitive drum 51 from being exposed to the foreign light.

Figure 7:
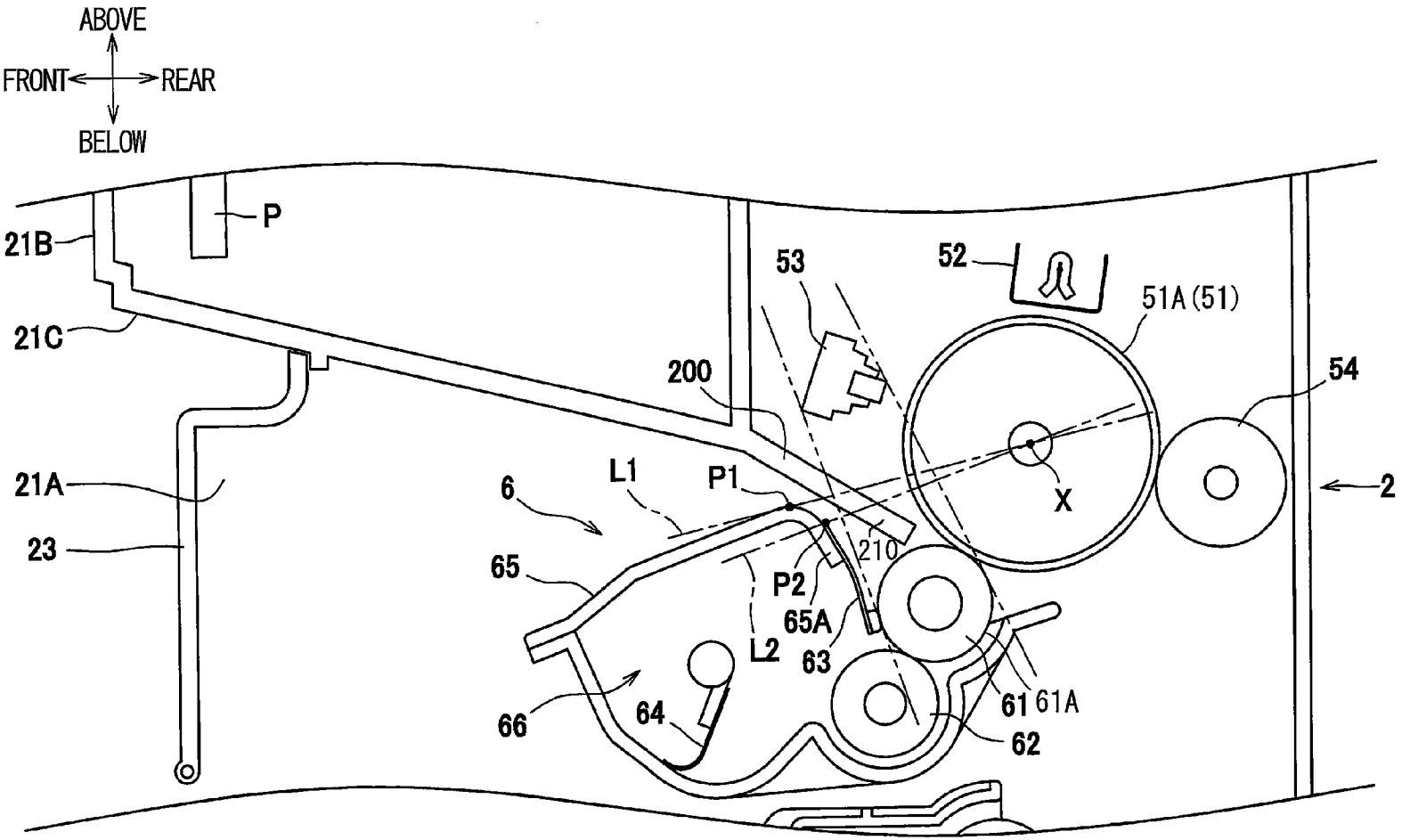
FIG. 7 is a cross-sectional view showing a light shielding wall of a laser printer according to a second modification of the present invention.

In the above-described embodiment, the light shielding wall 100 configured of the first and second segmental walls 110, 120 is generally L-shaped in cross-section. However, the shape of the light shielding wall may not necessarily be L-shaped but be such a shape as shown in FIG. 7 in which the modified light shielding wall is denoted by reference numeral 200. The light shielding wall 200 serving as an example of the light shielding member straightly extends diagonally downward toward the photosensitive drum 51 but the rear end portion thereof extends more diagonally downward than the remaining part of the light shielding wall 200. An end portion 210 of the light shielding wall 200 separates the exposure head 53 from the developing roller 61 and serves as a bottom cover of the exposure head 53. A part of the end portion 210 of the light shielding wall 200 is disposed in the triangular space formed between the photosensitive drum 51 and the developing roller 61.

The light shielding plate 200 as shown in FIG. 7 has also a foreign light shielding capability as attained in the above-described embodiment. Also, the light shielding wall 200 serves to protect the exposure head 61 so that the developing frame 65 and/or developing roller 61 does not accidentally impinge against the exposure head 61 when developing cartridge 6 is mounted in or dismounted from the main unit 2.

In the above-described embodiment, the second segmental wall 120 extends frontward above the front cover 23. The second segmental wall 120 may not be so elongated but be provided only between the exposure head 53 and the developing roller 61. If the second segmental wall 120 is modified in such a manner, it is desirable to provide in the front part of the main unit 2 a light shielding member for shielding the light entering from the upper part of the main unit 2.

In the above-described embodiment, the uppermost end of the fixing wall 65A to which the thickness regulating blade 63 is fixedly secured is set to be in coincidence with the uppermost position P1 of the developing cartridge 6. However, the uppermost position P1 of the developing cartridge 6 may be in any other position but may be determined depending upon the configuration of the developing cartridge 6 and/or the posture of the developing cartridge 6 mounted in the main unit 2.

Figure 8:
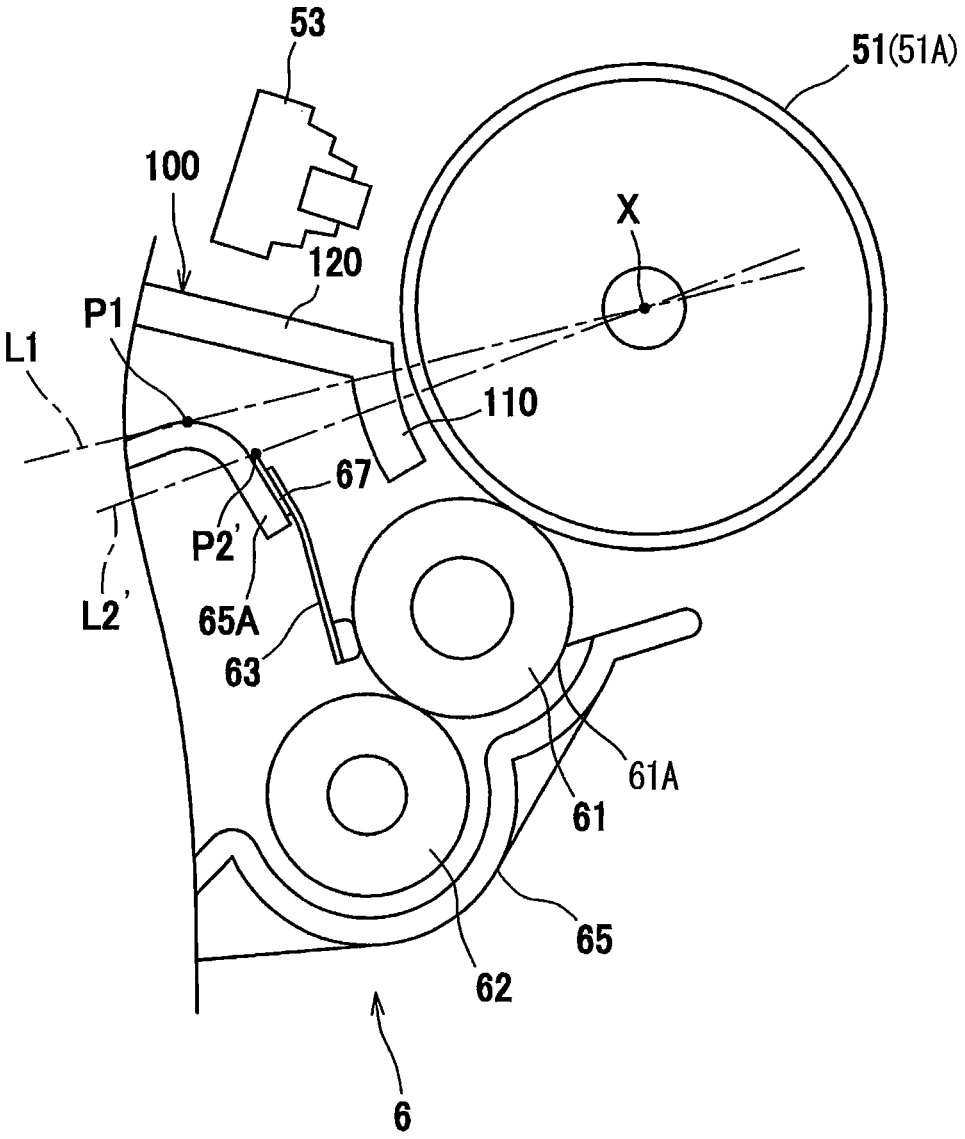
FIG. 8 is a cross-sectional view showing a developing cartridge of a laser printer according to a third modification of the present invention.

The above-described embodiment exemplifies the thickness regulating blade 63 as means for regulating the thickness of the toner layer deposited on the developing roller 61 and describes the position P2 of the thickness regulating blade 63 as being the uppermost position of the thickness regulating member. However, the shape and structure of the thickness regulating blade 63 is not limited to that shown and described. For example, as shown in FIG. 8, a thickness regulating assembly may be used which includes a thickness regulating blade 63 and a support member 67 for supporting the base end portion of the thickness regulating blade 63. The support member 67 is fixedly secured to the fixing wall 65A of the developing frame 65. The uppermost end of the support member 67 is positioned higher than the uppermost end position of the thickness regulating blade 63. If, however, the uppermost end of the support member 67 can be regarded as being in coincidence with the uppermost end position P2' of the thickness regulating blade 63, a plane L2' defined by inclusion of the uppermost end position P2' and axial line X of the photosensitive drum 51 may intersect with the first segmental wall 110.

What is claimed is:

1. An image forming apparatus comprising:

a casing;

a photosensitive drum rotatably disposed inside the casing, the photosensitive drum having a peripheral surface and an axial line;

an exposure head disposed to face the peripheral surface of the photosensitive drum, the exposure head being configured to expose the peripheral surface of the photosensitive drum to light;

a developing cartridge including a developing roller, the developing roller having a peripheral surface on which developer is born and being configured to supply the developer onto the peripheral surface of the photosensitive drum, the developing cartridge being mountable in and dismountable from the casing, the developing cartridge having an uppermost point and being disposed beneath the exposure head when mounted in the casing; and a light shielding member having a first portion that is disposed between the exposure head and the developing roller and intersects with an imaginary plane defined by inclusion of the axial line of the photosensitive drum and the uppermost point of the developing cartridge, wherein when the developing cartridge is mounted in the casing, the first portion of the light shielding member is disposed between the exposure head and the developing roller and intersects with an imaginary plane defined by inclusion of the axial line of the photosensitive drum and the uppermost point of the developing cartridge.

2. The image forming apparatus according to claim 1, wherein the developing cartridge further includes a thickness regulating member in contact with the peripheral surface of the developing roller and configured to regulate a thickness of developer layer born on the peripheral surface of the developing roller, the thickness regulating member having an uppermost point;

wherein the first portion of the light shielding member further intersects with an imaginary plane defined by inclusion of the uppermost point of the thickness regulating member and the axial line of the photosensitive drum.

3. The image forming apparatus according to claim 2, wherein the light shielding member comprises the first portion and a second portion, the first portion being generally extending along the peripheral surface of the photosensitive drum, and the second portion extending from the first portion and covering the exposure head.

4. The image forming apparatus according to claim 3, wherein the light shielding member is general L-shaped in cross-section.

5. The image forming apparatus according to claim 3, wherein the first portion comprises a light shielding film.

6. The image forming apparatus according to claim 1, wherein the casing has an opening in a position opposite the photosensitive drum with respect to the light shielding member;

wherein the image forming apparatus further comprises a cover configured to cover and expose the opening.

7. The image forming apparatus according to claim 1, wherein the light shielding member comprises a wall.

8. The image forming apparatus according to claim 1, wherein the light shielding member is secured to the casing.

* * * * *